US005608415A

United States Patent [19]

Sugawara

[11] Patent Number: 5,608,415

[45] Date of Patent: Mar. 4, 1997

[54] HIGH-FREQUENCY SIGNAL TRANSMISSION SYSTEM WITH CONICAL CONDUCTORS AND BIAS RESISTOR

[76] Inventor: Goro Sugawara, 27-20, Komatsushima 4-chome, Aoba-ku, Sendai-shi, Miyagi-ken, Japan

[21] Appl. No.: 453,519

[22] Filed: May 30, 1995

Related U.S. Application Data

[62] Division of Ser. No. 201,333, Feb. 24, 1994, Pat. No. 5,508,669.

[30] Foreign Application Priority Data

Feb. 26, 1993 [JP] Japan ..... 5-061471

[51] Int. Cl.[6] ..... H01P 1/30; H01Q 11/02

[52] U.S. Cl. ..... 343/731; 333/206; 333/207; 333/202; 333/34; 343/767; 343/830; 343/863

[58] Field of Search ..... 333/34, 206, 207, 333/245, 202; 343/731, 767, 863, 830

[56] References Cited

U.S. PATENT DOCUMENTS

| | | | |
|---|---|---|---|
| 3,058,073 | 10/1962 | Eldredge | 333/34 |
| 3,209,287 | 9/1965 | Oxner et al. | 333/34 |
| 3,419,813 | 12/1968 | Kamnitsis | 333/34 |
| 3,909,755 | 9/1975 | Kaunzinger | 333/206 |
| 5,508,669 | 4/1996 | Sugawara | 333/206 |

FOREIGN PATENT DOCUMENTS

| | | |
|---|---|---|
| 62-51802 | 3/1987 | Japan . |
| 6252601 | 9/1994 | Japan . |

OTHER PUBLICATIONS

"The Transmission Characteristics of the Circuits Constructed with the Cascade Connection of Unit Exponential Lines", G. Sugawara et al., The Technology Reports of Tohku Univ., vol. 45, (1980), pp. 273–286 no month.

"Microwave Transmission Circuits", George L. Bagan, McGraw–Hill Book Company, Inc. (1948), pp. 9–13 of Chapter 2, 24, 184–188 and 614–615 no month.

*Primary Examiner*—Benny T. Lee
*Assistant Examiner*—Darius Gambino
*Attorney, Agent, or Firm*—Fish & Richardson P.C.

[57] ABSTRACT

A high-frequency signal transmission system for use as a microwave antenna or filter has a plurality of cascaded conical or planar inner conductors each having a unitary exponential gradient, a pair of circular lines or impedance-matching lines having identical dimensions and connected respectively to opposite ends of the conical or planar inner conductor for providing a predetermined characteristic impedance, and a cylindrical or rectangular tubular outer conductor covering the conical or planar inner conductor and the circular or impedance-matching lines with a cavity defined between the conical or planar inner conductor and the cylindrical or rectangular tubular outer conductor.

10 Claims, 9 Drawing Sheets

COAXIAL UNIT EXPONENTIAL LINE OF CONICAL INNER CONDUCTOR

HIGH-FREQUENCY SIGNAL TRANSMISSION SYSTEM WITH CONICAL CONDUCTORS AND BIAS RESISTOR

This application is a division of U.S. application Ser. No. 08/201,333, filed Feb. 24, 1994, now U.S. Pat. No. 5,508,669, issued 12 Apr. 1996.

BACKGROUND OF THE INVENTION

1. Field of the Invention

The present invention relates to a high-frequency signal transmission system for use as a microwave antenna, a microwave filter, or the like, which transmits microwave signals with a reduced coupling capacitance in a wide frequency range without distortion and phase delay.

2. Description of the Prior Art

Recent microwave signal transmission such as radio signal transmission for mobile telephone, for example, requires an increase in the range of transmission frequencies and a reduction in the transmission loss.

One known microwave transmission system is disclosed in U.S. Pat. No. 3,909,755 entitled "LOW PASS MICROWAVE FILTER".

FIG. 1 of the accompanying drawings is a perspective view, partly in cross section, of such a conventional low-pass microwave filter. As shown in FIG. 1, the low pass microwave filter has a plurality of cascade-connected conical inner conductors 2*a*, 2*b*, 2*c*, an outer conductor 4 covering the inner conductors 2*a*–2*c*, and an insulator tube 6 disposed in close contact between the maximum-diameter outer surfaces of the inner conductors 2*a*–2*c* and the inner surface of the outer conductor 4. The insulator tube 6 insulatively holds the inner conductors 2*a*–2*c*, and serves as a dielectric member. A connector conductor 8 is joined to the right-hand end (as viewed in FIG. 1) of the inner conductor 2*c*. A high-frequency signal RFIN is supplied between the connector conductor 8 and an end of the outer conductor 4. Another connector conductor 10 is joined to the left-hand end (as viewed in FIG. 1) of the inner conductor 2*a*. A high-frequency signal RFOUT is outputted across a load R which is connected between the connector conductor 10 and an opposite end of the outer conductor 4.

Each of the conical inner conductors 2*a*–2*c* is a wide-range exponential line. The frequency range of each of the conical inner conductors 2*a*–2*c* can be set to a desired range by varying the total length (λ/2) and the diameters at the opposite ends thereof. Since the insulator tube 6 which mechanically supports the conical inner conductors 2*a*–2*c* serves as a dielectric member, as described above, the frequency range of each of the conical inner conductors 2*a*–2*c* is selected in view of the dielectric constant of the insulator tube 6. The high-frequency signal RFIN supplied between the connector conductor 8 and the end of the outer conductor 4 is processed into characteristics corresponding to the transmission characteristics of the high-frequency signal transmission system, and outputted as the high-frequency signal RFOUT between the connector conductor 10 and the opposite end of the outer conductor 4.

The conical inner conductors 2*a*–2*c* may be replaced with a plurality of discs having successively greater external dimensions and fixed in position by a shaft extending centrally through the discs. Alternatively, the conical inner conductors 2*a*–2*c* and the outer conductor 4 may be switched around in structure. Specifically, the outer conductor 4 may be shaped complementarily to the conical inner conductors 2*a*–2*c*, and an insulator member may extend centrally through the outer conductor 4 with a central conductor being disposed in the insulator member. As another alternative, a stripline comprising a plurality of cascaded triangular plates may be used as a substitute for the conical inner conductors 2*a*–2*c*.

In the conventional low-pass microwave filter disclosed in U.S. Pat. No. 3,909,755, the insulator tube 6 may be dispensed with, and the inner conductors 2*a*–2*c* in the outer conductor 4 may be fixed in place by insulating screws that are made of plastic.

According to the conventional low-pass microwave filter, the inner conductors 2*a*–2*c* are positioned in the outer conductor 4 by the insulator tube 6 that is disposed between the inner conductors 2*a*–2*c* and the outer conductor 4. Therefore, the low-pass microwave filter develops a great reflected-wave power against the traveling-wave power of a high-frequency signal that is supplied thereto, resulting in a poor standing-wave ratio (V.SWR). More specifically, the dielectric strain of the insulator tube 6 causes a phase delay in the transmitted high-frequency signal, and attachment members develops a loss, thereby failing to generate an isotropic electromagnetic field and hence to provide transmission characteristics equal to the radio wave propagation speed in free space.

The maximum-diameter portions of the cascaded conical inner conductors 2*a*–2*c* comprise flat joint surfaces each having a width of λ/20 which are held in contact with the insulator tube 6. Therefore, the conical inner conductors 2*a*–2*c* are mechanically stably supported in the insulator tube 6. The flat joint surfaces of the conical inner conductors 2*a*–2*c* are, however, line portions where the outer configuration of the conical inner conductors 2*a*–2*c* is not exponentially represented. Since the coupling capacitance is increased at the flat joint surfaces, it is impossible to construct wide-range exponential lines that are consistent with the theoretical principles. Furthermore, the joints between the conical inner conductors 2*a*–2*c* develop a large coupling capacitance due to the dielectric constant of the insulator tube 6, resulting in poor response characteristics which limit the transmission frequency range. Even if the insulator tube 6 is dispensed with and the insulating screws are employed, a parasitic capacitance is produced which results in poor response characteristics which limit the transmission frequency range. Moreover, inasmuch as the opposite ends of the inner conductors 2*a*–2*c* and the outer conductor 4 are of a uniform diffraction open structure, the high-frequency signal that is being transmitted leaks as an undesired radiation. Consequently, nearby electronic devices tend to suffer electromagnetic interference (EMI).

SUMMARY OF THE INVENTION

It is therefore an object of the present invention to provide a high-frequency signal transmission system having a plurality of cascaded exponential transmission lines with a reduced coupling capacitance for transmitting a high-frequency signal in an unlimited wide frequency range without causing a phase delay between input and output high-frequency signals, the exponential transmission lines being consistent with the theoretical principles for high-frequency signal transmission without distortion at maximum efficiency.

To achieve the above object, there is provided a high-frequency signal transmission system comprising a conical inner conductor having a unitary exponential gradient, a pair of circular lines having identical dimensions and connected respectively to opposite ends of the conical inner conductor for providing a predetermined characteristic impedance, and a cylindrical outer conductor covering the conical inner conductor and the circular lines with a cavity defined between the conical inner conductor and the cylindrical outer conductor.

The high-frequency signal transmission system may include a plurality of cascaded conical inner conductors each having a unitary exponential gradient as the conical inner conductor. The conical inner conductor may comprise an exponential line. The high-frequency signal transmission system may further comprise a pair of coaxial connectors connected respectively to the opposite ends of the conical inner conductor and to opposite ends of the cylindrical outer conductor. The conical inner conductor may be made of a synthetic resin material with an electrically conductive layer disposed on an outer circumferential surface thereof. The conical inner conductor may comprise a hollow conical inner conductor made of an electrically conductive material.

The high-frequency signal transmission system may further comprise a Vπ bias resistor connected between an end of one of the circular lines which is connected to one of the opposite ends thereof and the cylindrical outer conductor, and a feeder connected between the other end of the conical inner conductor and the cylindrical outer conductor, the cylindrical outer conductor having a longitudinal slit defined therein, whereby the high-frequency signal transmission system can operate as an RF traveling-wave antenna.

Alternatively, the high-frequency signal transmission system may further comprise a lead connected to one of the opposite ends of the conical inner conductor, a Vπ bias resistor connected between an end of one of the circular lines which is connected to the one of the opposite ends thereof and the cylindrical outer conductor, and a feeder connected between the other end of the conical inner conductor and the cylindrical outer conductor, the cylindrical outer conductor having a longitudinal slit defined therein, whereby the high-frequency signal transmission system can operate as an RF traveling-wave antenna.

According to the present invention, there is also provided a high-frequency signal transmission system comprising a planar inner conductor having opposite sides each having a unitary exponential gradient, a pair of impedance-matching lines having identical dimensions and connected respectively to opposite ends of the conical inner conductor for providing a predetermined characteristic impedance, and a rectangular tubular outer conductor covering the planar inner conductor and the impedance-matching lines with a cavity defined between the planar inner conductor and the rectangular tubular outer conductor.

The planar inner conductor may comprise an exponential line. The high-frequency signal transmission system may include a plurality of cascaded planar inner conductors each having opposite sides each having a unitary exponential gradient as the planar inner conductor. The high-frequency signal transmission system may further comprise a pair of coaxial connectors connected respectively to the opposite ends of the planar inner conductor and to opposite ends of the rectangular tubular outer conductor.

The high-frequency signal transmission system may further comprise a Vπ bias resistor connected between an end of one of the impedance-matching lines and the rectangular tubular outer conductor, and a feeder connected between an end of the other impedance-matching line and the rectangular tubular outer conductor, the rectangular tubular outer conductor having a longitudinal slit defined therein, whereby the high-frequency signal transmission system can operate as an RF traveling-wave antenna.

Alternatively, the high-frequency signal transmission system may further comprise a lead connected to one of the impedance-matching lines, a Vπ bias resistor connected between an end of the one of the impedance-matching lines and the rectangular tubular outer conductor, and a feeder connected between an end of the other impedance-matching line and the rectangular tubular outer conductor, the rectangular tubular outer conductor having a longitudinal slit defined therein, whereby the high-frequency signal transmission system can operate as an RF traveling-wave antenna.

According to the present invention, there is further provided a high-frequency signal transmission system comprising a plurality of high-frequency signal transmission systems which have different resonant frequencies, the high-frequency signal transmission systems being connected parallel to each other for transmitting a plurality of high-frequency signals in respective different frequency ranges, respectively, therethrough.

A high-frequency signal transmission system may further comprise an exponential line having a characteristic impedance at a central region thereof, and a circuit connected to the exponential line and having input and output terminals with respective resistances, the characteristic impedance and the resistances of input and output terminals being equalized to each other and maximum and minimum outside diameters of the exponential line being determined to achieve impedance matching for signals received by and transmitted from the circuit.

With the above arrangement, the cavity is defined between the inner conductor which is an accurate exponential line and the outer conductor, and the opposite ends thereof are sealed by Vπ bias resistors to prevent high-frequency signals from leaking therethrough. A fixed conjugate coupling between transmission and reception feed points in cascaded coaxial exponential gradient transmission lines prevents any phase delay from occurring due to a coupling capacitance, thereby providing wide-range exponential lines that are consistent with the RF traveling-wave reciprocity circuit theory for transmitting high-frequency signals highly efficiently without distortion.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
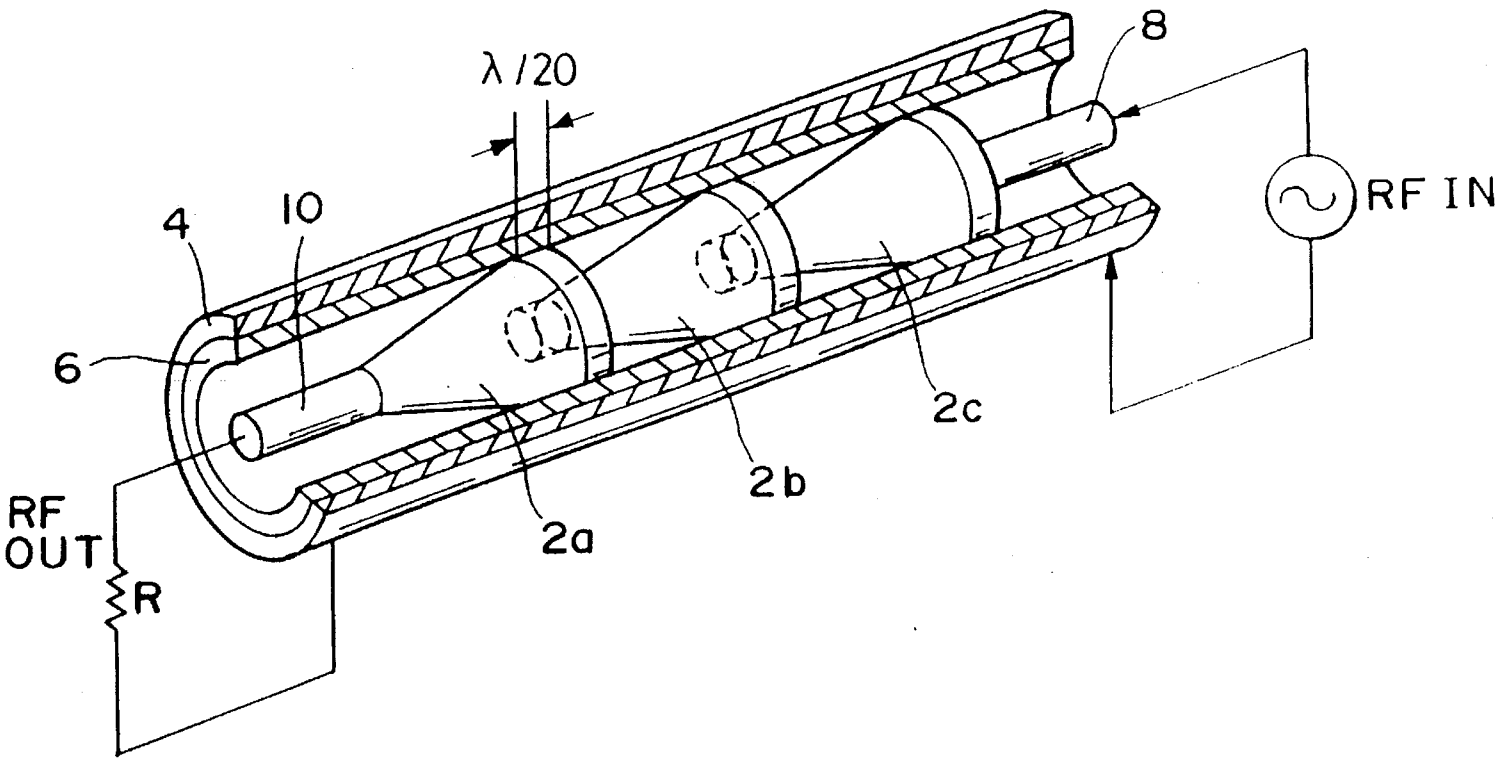
FIG. 1 PRIOR ART
FIG. 1 is a perspective view, partly in cross section, of a conventional low-pass microwave filter.
Figure 2:
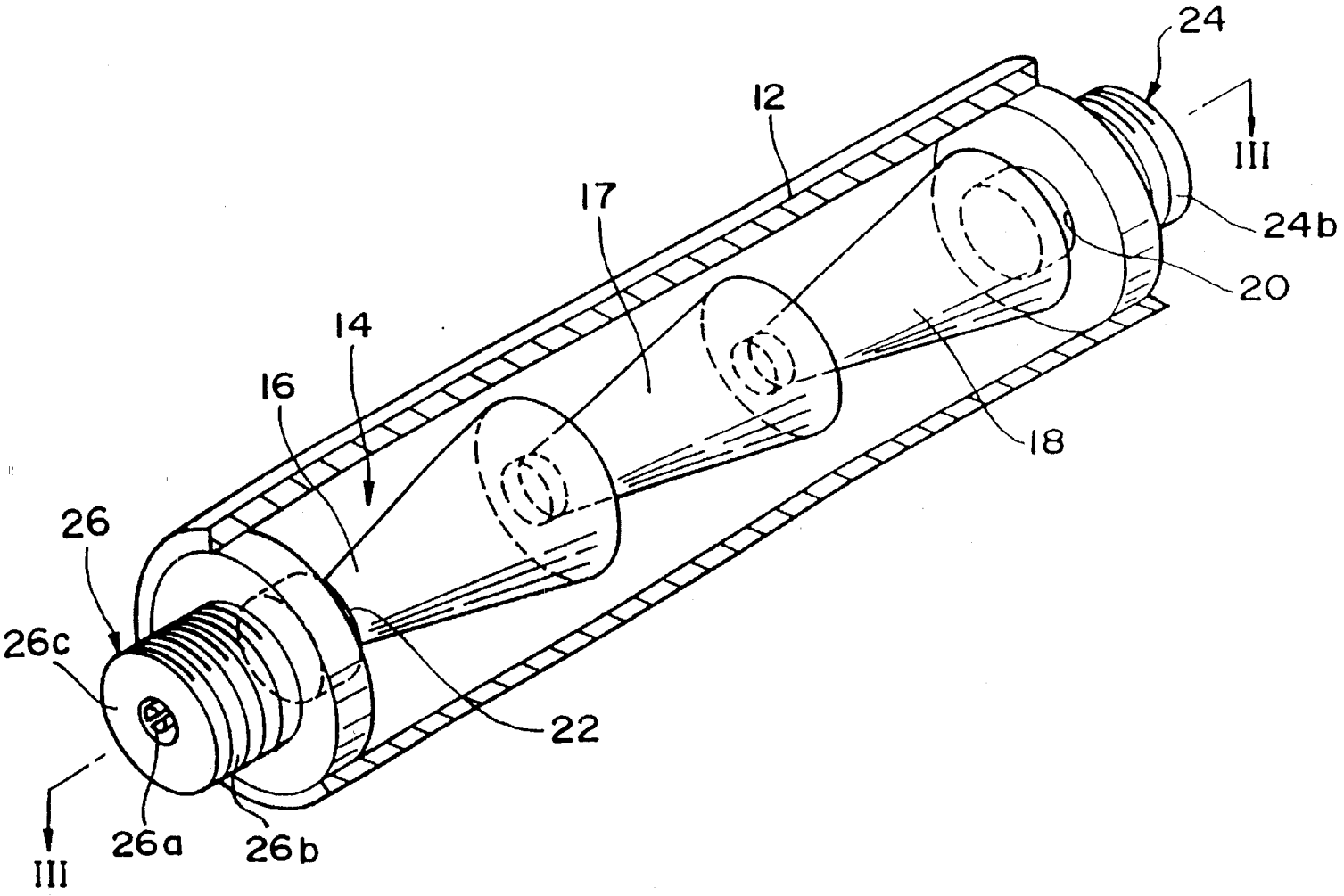
FIG. 2 is a perspective view, partly in cross section, of a high-frequency signal transmission system according to a first embodiment of the present invention.
Figure 3:
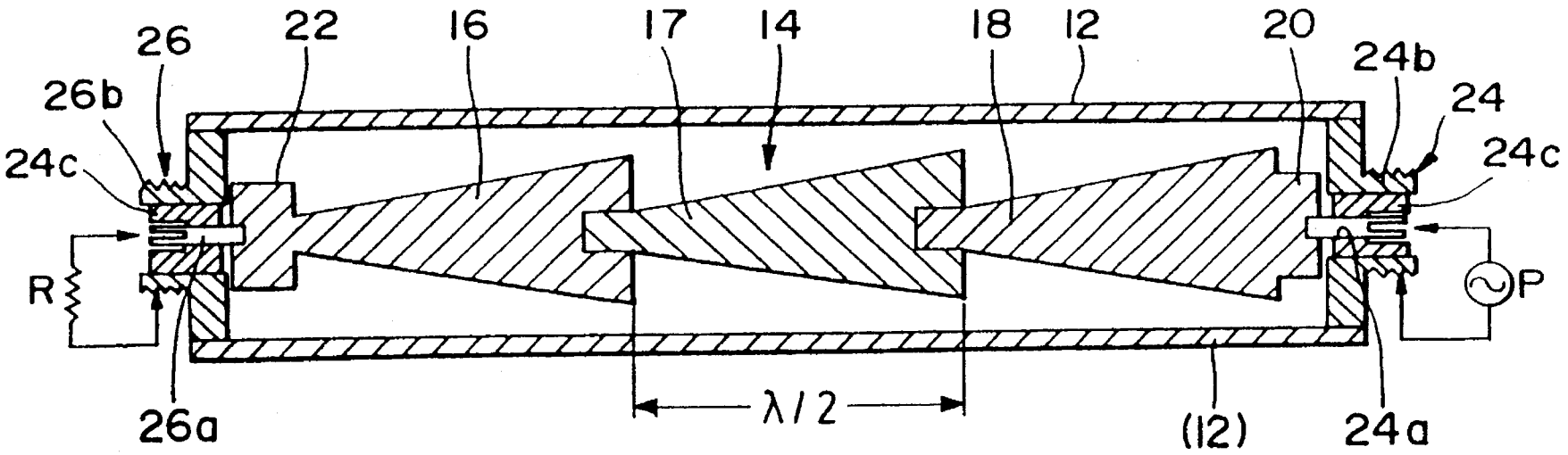
FIG. 3 is a cross-sectional view taken along line III—III of FIG. 2.

As shown in FIGS. 2 and 3, a high-frequency signal transmission system according to a first embodiment of the present invention comprises a hollow cylindrical outer conductor 12, a plurality of conical inner conductors 16, 17, 18 disposed in a space 14 within the outer conductor 12 and providing unitary exponential gradients, i.e., natural base exponential lines, each of the inner conductors 16, 17, 18 having a total length of $\lambda/2$, an impedance-matching circular line 20 joined to the maximum-diameter portion of the inner conductor 18, and an impedance-matching circular line 22 joined to the minimum-diameter portion of the inner conductor 16. Known N-type coaxial connectors 24, 26 are connected the respective opposite ends of the outer conductor 12.

In the illustrated embodiment, the circular line 22 and the inner conductor 16 are integral with each other, the circular line 22 being cut to shape on the minimum-diameter portion of the inner conductor 16. The maximum-diameter portion of the inner conductor 16, which is opposite to the minimum-diameter portion thereof, has a central recess defined therein, and the inner conductor 17 has a minimum-diameter portion press-fitted or threaded into the recess in the maximum-diameter portion of the inner conductor 16. The maximum-diameter portion of the inner conductor 17, which is opposite to the minimum-diameter portion thereof, has a central recess defined therein, and the inner conductor 18 has a minimum-diameter portion press-fitted or threaded into the recess in the maximum-diameter portion of the inner conductor 17. The circular line 20 and the inner conductor 18 are integral with each other, the circular line 20 being cut to shape on the maximum-diameter portion of the inner conductor 18, which is opposite to the minimum-diameter portion thereof. The circular lines 20, 22 are of the same diameter as each other and also as the longitudinally intermediate exact half point portion of each of the inner conductors 16–18. The diameter of the circular lines 20, 22 and the inside diameter of the outer conductor 12 are selected to achieve a certain characteristic impedance such as of 50Ω, for example.

The N-type coaxial connector 24 on one end of the outer conductor 12 has a central conductor (central contact) 24*a* (see FIG. 3) having one end press-fitted or threaded into the circular line 20. The N-type coaxial connector 24 also has an outer conductor 24*b* press-fitted or threaded into the end of the outer conductor 12. Similarly, the N-type coaxial connector 26 on the other end of the outer conductor 12 has a central conductor (central contact) 26*a* having one end press-fitted or threaded into the circular line 22. The N-type coaxial connector 26 also has an outer conductor 26*b* press-fitted or threaded into the other end of the outer conductor 12. The central conductor 24*a* is coaxially disposed in the outer conductor 24*b* with an insulator 24*c* interposed therebetween. The central conductor 26*a* is coaxially disposed in the outer conductor 26*b* with an insulator 26*c* interposed therebetween. The inner conductors 16–18 are thus positioned on the central axis of the outer conductor 12.

The N-type coaxial connector 24 is connected to a transmission power source P, for example, and the N-type coaxial connector 26 is connected to a dummy load (artificial terminal resistor) R.

Operation of the high-frequency signal transmission system according to the first embodiment will be described below.

First, operation of the high-frequency signal transmission system which is used as a low-pass filter (LPF) will be described below. If the high-frequency signal transmission system shown in FIGS. 2 and 3 has a cutoff frequency (Fcut) of 1.6 GHz, a maximum pass-band attenuation level ($\alpha_{max}$) of 1 dB, and a minimum stop-band attenuation level ($\alpha_{min}$) of 20 dB, then each of the inner conductors 16–18 has a total length of 64.0 mm, a minimum diameter of 3.88 mm, and a maximum diameter of 13.57 mm. The outer conductor 12 has a diameter of 20.6 mm.

The transmission line characteristics can fully be determined by the secondary constant of a transmission line which has a characteristic impedance $Z_0$ and a propagation constant $\gamma$. The pure imaginary part of the propagation constant $\gamma$ represents a pass-band with a pass-band width $\pi$ radian and real part $\alpha=0$ of $\gamma$ thereof corner frequency of a stop band. The stop-band has a maximum attenuation level $\alpha_{max}$ at a maximum design frequency $f_0$ thereof.

Figure 4:
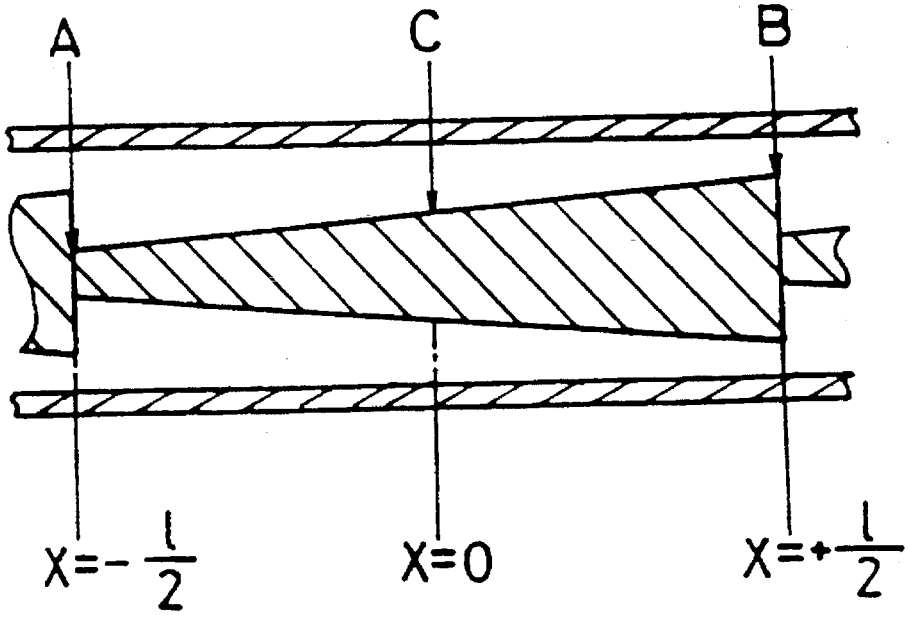
FIG. 4 is shown unit exponential line having the characteristic impedance distribution of $W_0 \exp(\delta x)$ and the physical length l.

FIG. 4 shows a unit exponential line having a physical length l and a characteristic impedance distribution of $W_0 \exp(\delta x)$. As shown in FIG. 4, the characteristic impedance of the unit exponential line is defined as $W_0$ with $\exp(0)=1$ at a point X=0 that is located at half the length of the unit exponential line. At points other than the point X=0, the characteristic impedance of the unit exponential line cannot be defined because the base e is an infinite number. If the defined characteristic impedance $Z_0$ is 50Ω, then impedances at various points of the unit exponential line are given as follows:

Point A: $138 \log_{10} 20.6/3.88=100\Omega$,

Point B: $138 \log_{10} 20.6/13.57=25\ \Omega$, and

Point C: $138 \log_{10} 20.6/9.00=50\Omega$.

Where a coaxial unit exponential line is designed with a normalized characteristic impedance of 50Ω at the center X=0, it is represented by two cascaded circuits of a conjugate-matched uniform-impedance line. The coaxial unit exponential line has a monotonous negative reactance gradient whose pass-band $\gamma$ ranges from j0 to $j\pi$, and can serve as a coaxial-line wide-band matching unit for balanced symmetrical feeding.

It is necessary that the inner conductors 16–18 be fixed between the central conductor 24*a* of the N-type coaxial connector 24 and the central conductor 26*a* of the N-type coaxial connector 26 and be stably held on the central axis of the outer conductor 12. From the standpoint of possible weights exerted, it is preferable to make the inner conductors 16–18 of a light metallic material such as aluminum, Duralumin, or the like. Alternatively, each of the inner conductors 16–18 may be of a hollow structure of brass, or may be made of plastic with an electrically conductive layer evaporated on its outer circumferential surface. In the cascaded low-pass filter, each of the inner conductors 16–18 provides a characteristic impedance Zo proportional to the logarithm of the ratio of the outer conductor diameter to the inner conductor diameter as is the case with a general coaxial transmission line. In the illustrated arrangement, the diameter of the circular lines 20, 22 and the diameter of the intermediate portions of the inner conductors 16–18 are equal to each other thereby to set the characteristic impedance equivalently to 50Ω. Such an exponential line is described in "MICRO-WAVE TRANSMISSION CIRCUITS" published by McGraw-Hill Company, Inc. in 1948.

Based on a theoretical analysis of a circuit composed of nonuniform lines, the inventor has found out that where such nonuniform lines comprise exponential lines, the circuit serves as an ideal low-pass filter if it is fed while its characteristic impedance has a certain relationship to connecting conditions for the input and output terminals thereof. Such a relationship is disclosed in "The Transmission Characteristics of the Circuits Constructed with the Cascade Connection", Tohoku University Technical Report, Vol. 45 (1980), No. 2, December, at pages 273–286.

According to the first embodiment, a cavity is present between the conical inner conductors 16–18 that are unitary natural base exponential lines and the outer conductor 12, and the opposite ends of the outer conductor 12 are sealed against leakage of high-frequency signals by the circular lines 20, 22 and the N-type coaxial connectors 24, 26, without any dielectric insulation interposed between the inner conductors 16–18 and the outer conductor 12. As no flat joint surfaces each having a width of λ/20 contact any insulator tube, a reciprocity zero-dB coupling is achieved between the cascade-connected exponential lines to avoid any phase delay between input and output high-frequency signals for thereby accurately synchronizing the input and output high-frequency signals. Furthermore, any reflected-wave power produced against the traveling-wave power of the input high-frequency signal is greatly reduced to cause the standing-wave ratio (V.SWR) to approach 1.0. Accordingly, the high-frequency signal that is being transmitted does not suffer a phase delay, but an isotropic electromagnetic field is generated to provide transmission characteristics equal to the radio wave propagation speed in free space. The sealed structure at the opposite ends of the low-pass filter prevents the high-frequency signal from leaking as an undesired radiation, and hence nearby electronic devices are free from electromagnetic interference (EMI).

Figure 5:
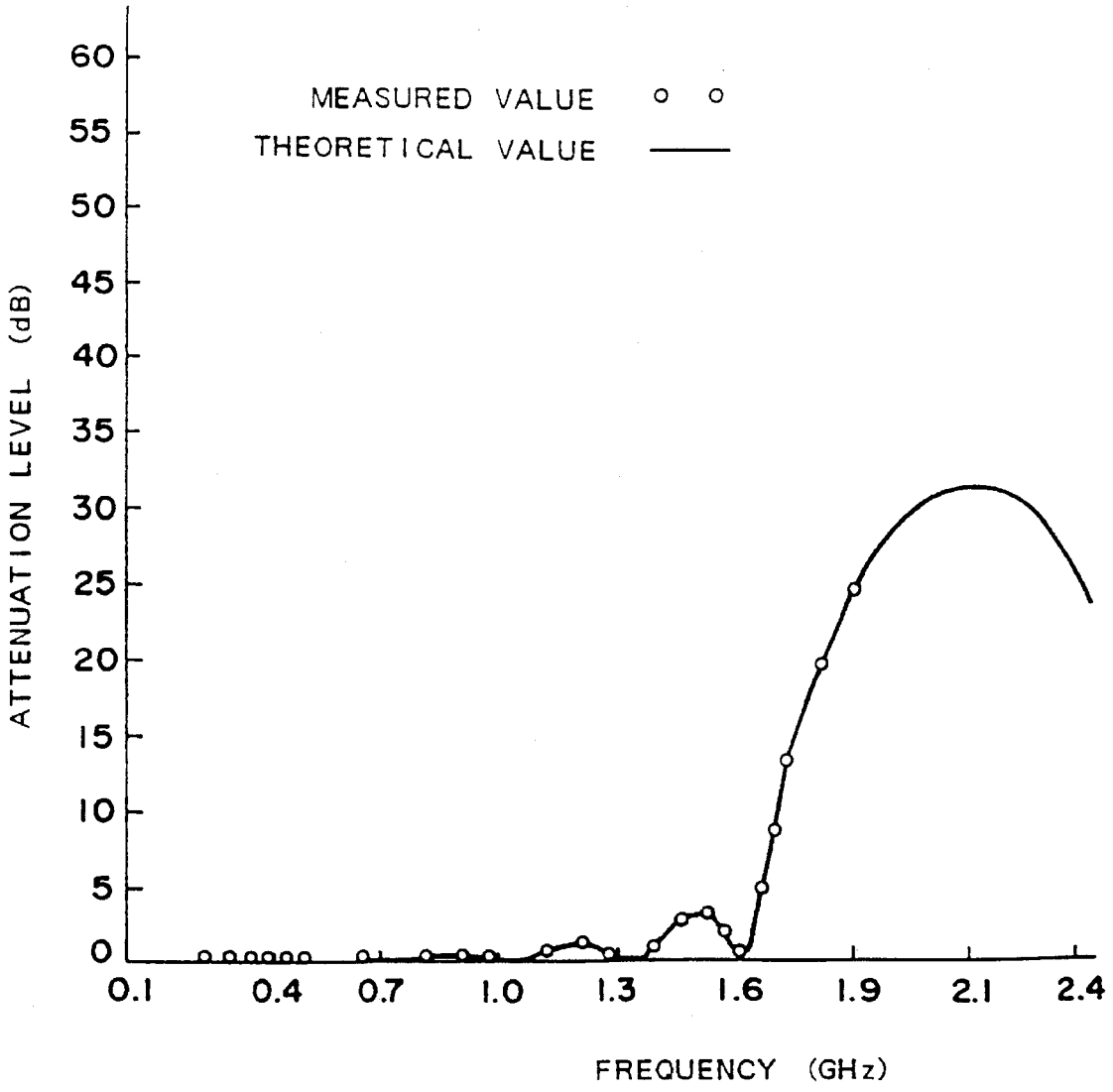
FIG. 5 is a diagram showing measured attenuation levels of a high-frequency signal transmission system as it operates.

FIG. 5 shows attenuation levels measured when a low-pass filter was in operation. The low-pass filter which was measured had a total of six cascaded inner conductors, i.e., two sets of inner conductors 16–18 as shown in FIGS. 2 and 3. Each of the six cascaded inner conductors had a total length of 64.0 mm, a minimum diameter of 3.88 mm, and a maximum diameter of 13.57 mm. The low-pass filter had a cutoff frequency (Fcut) of 1.6 GHz, a maximum pass-band attenuation level ($\alpha_{max}$) of 1 dB, and a minimum stop-band attenuation level ($\alpha_{min}$) of 20 dB (1.8 GHz). The minimum-diameter portion, intermediate half point portion, and maximum-diameter portion of each of the inner conductors 16–18 had characteristics impedances of 100Ω, 50Ω, and 25Ω, respectively. The attenuation levels were measured using a known RF network analyzer. The graph of FIG. 5 indicates that measured values indicated by ○ coincide well with theoretical values, and that the low-pass filter had ideal attenuation levels.

Figure 6:
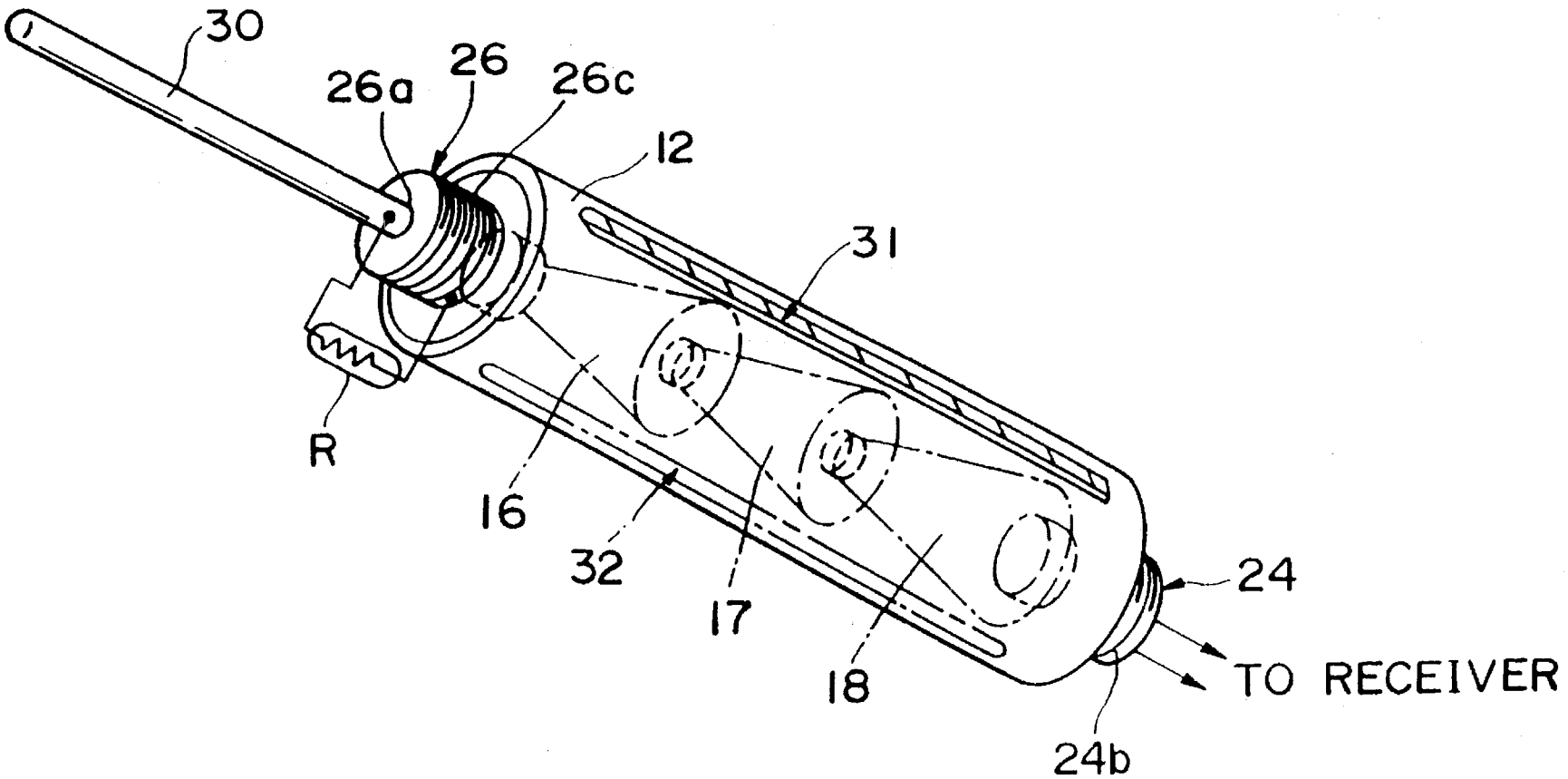
FIG. 6 is a perspective view of an RF traveling-wave antenna according to a second embodiment of the present invention, which incorporates the high-frequency signal transmission system shown in FIGS. 2 and 3.

FIG. 6 shows an RF traveling-wave antenna according to a second embodiment of the present invention, which incorporates the high-frequency signal transmission system shown in FIGS. 2 and 3. As shown in FIG. 6, the RF traveling-wave antenna comprises, in addition to the components of the high-frequency signal transmission system shown in FIGS. 2 and 3, a rod-shaped antenna element 30 having one end inserted into the central conductor **26*a* of the N-type coaxial connector 26, and a resistor R of 120Ω, for example, connected between the central conductor 26*a* and the outer conductor 26*b*. The outer conductor 12 has a pair of longitudinal slits 31, 32 defined therein in diametrically opposite relationship to each other, i.e., spaced 180° from each other. The slits 31, 32 serve as equivalent triplet exponential line boresight for making any reception probe unnecessary for reception of low-frequency signals. While the antenna element 30 may be dispensed with when the slits 31, 32 are provided, the RF traveling-wave antenna has both the antenna element 30 and the slits 31, 32. The N-type coaxial connector 26** may not necessarily be employed.

Figure 7:
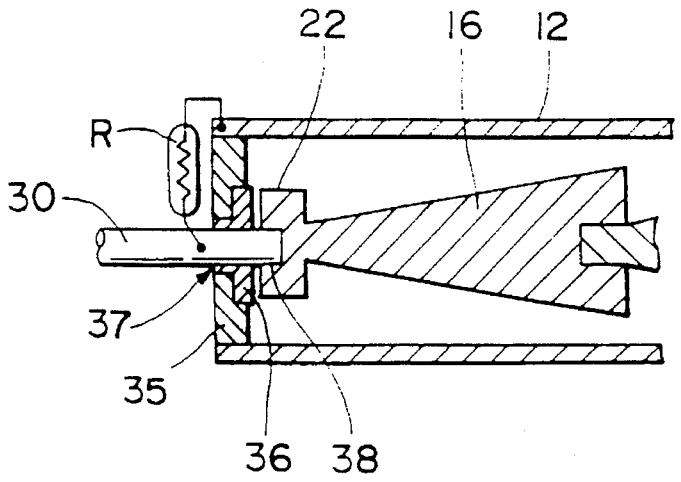
FIG. 7 is a fragmentary cross-sectional view of a modification of the RF traveling-wave antenna according to the second embodiment, which is free of an N-type coaxial connector.

FIG. 7 illustrates a modification of the RF traveling-wave antenna according to the second embodiment. In FIG. 7, the RF traveling-wave antenna is free of the N-type coaxial connector 26. More specifically, as shown in FIG. 6, a metal member 35 is fitted in an open end of the outer conductor 12 from which the N-type coaxial connector 26 has been removed, and an insulator 36 is disposed between a central region of the metal member 35 and the circular line 22. The end of the antenna element 30 is inserted in a central through hole 37 defined in the insulator 36 that is supported in the metal member 35, and is fixedly mounted in a central hole 38 defined in the circular line 22. The structure shown in FIG. 7 permits the inner conductors 16–18 to be positioned on the central axis of the outer conductor 12, and to be held centrally in the outer conductor 12.

The resistance of 120Ω is determined by the equation of a characteristic impedance:

$$Zo=120\ \ln(So/S)^{1/4}$$

where $\ln(So/S)^{1/4}$(So/S represents the aperture ratio) is the coaxial unitary bias base line logarithmic differential aperture ratio and gives an axial ratio of 1. Accordingly, since a coaxial-line-twin-aperture-terminals electromotive force unit Vπ of 120 dBμ causes the outer conductor to be held at a potential 0 with a bias load of 120 Ω, there can be realized a balanced feeding transmission line for a standard signal 0 dBm+7 dB.

Operation of the RF traveling-wave antenna according to the second embodiment will be described below.

The RF traveling-wave antenna provides a 120-ohm Vπ bias load coaxial unitary aperture phase plane achieving an infrared-in-time fully synchronous condition. Since no low frequency range is cut off, therefore, the RF traveling-wave antenna according to the second embodiment can be used as a traveling-wave antenna which is a π-steradian isotropic radiator. The slits 31, 32 provide a triplet balanced transmission path along with a propagation axis in the antenna, i.e., a λ/2 exponential line traveling-wave resonator, shown in FIGS. 2 and 3, achieving a maximum reciprocity conjugate transmission capacity. Consequently, since RF traveling-wave antenna can produce a reception level sufficiently high to trigger an infrared radiation, it can effectively be used as an isotropic-radiation traveling-wave antenna.

Using the RF traveling-wave antenna, radio signals were well received particularly in a low-frequency range. For example, the program "The Voice of Andes" broadcast from Ecuador at a frequency of 3220 KHz, which has been impossible to receive with a conventional antenna, could be received at 10 PM with an electric field intensity ranging from 30.0 dB to 42.0 dB. In addition, the program "M1-R01" broadcast from Russia at a frequency of 4050 KHz could be received at 2 PM with an electric field intensity ranging from 10.0 dB to 18.0 dB. Other received broadcasts in the VHF and UHF bands with Vπ potential received signal intensities are given in the following table 1:

TABLE 1

Received broadcasts (the IF attenuator had a constant attenuation level of 10 dB, and audio broadcast waves were received for all TV broadcast waves)

| Frequency (MHz) | Station | Field intensity (dBi) | Received power (dBm) | DC voltage (mV) | AC voltage (mV) |
|---|---|---|---|---|---|
| 77.10 | FM Sendai | 46.5 | 8.5 | 650 | 80 |
| 82.50 | NHK FM | 45.5 | 9.0 | 882 | 66 |
| 95.75 | Tohoku Broadcasting | 51.5 | 6.8 | 445 | 21 |
| 107.75 | NHK General TV | 59.5 | 6.8 | 1026 | 29 |
| 181.75 | NHK Educational TV | 47.5 | 5.8 | 736 | 27 |
| 221.75 | Sendai Broadcasting TV | 35.0 | 8.5 | 1530 | 70 |
| 21.54 | VOA | 28.0 | 20.3 | 997 | 87 |
| 67.01 | TV program relayed | 28.0 | 10.8 | 837 | 46 |
| 589.75 | 32CH TV | 49.0 | 13.0 | 833 | 53 |
| 601.75 | 34CH TV | 52.0 | 12.1 | 510 | 46 |

While the three conical inner conductors 16–18 are connected in cascade in the first and second embodiments, only one of the conical inner conductors 16–18 may be used in the high-frequency signal transmission system.

Figure 8:
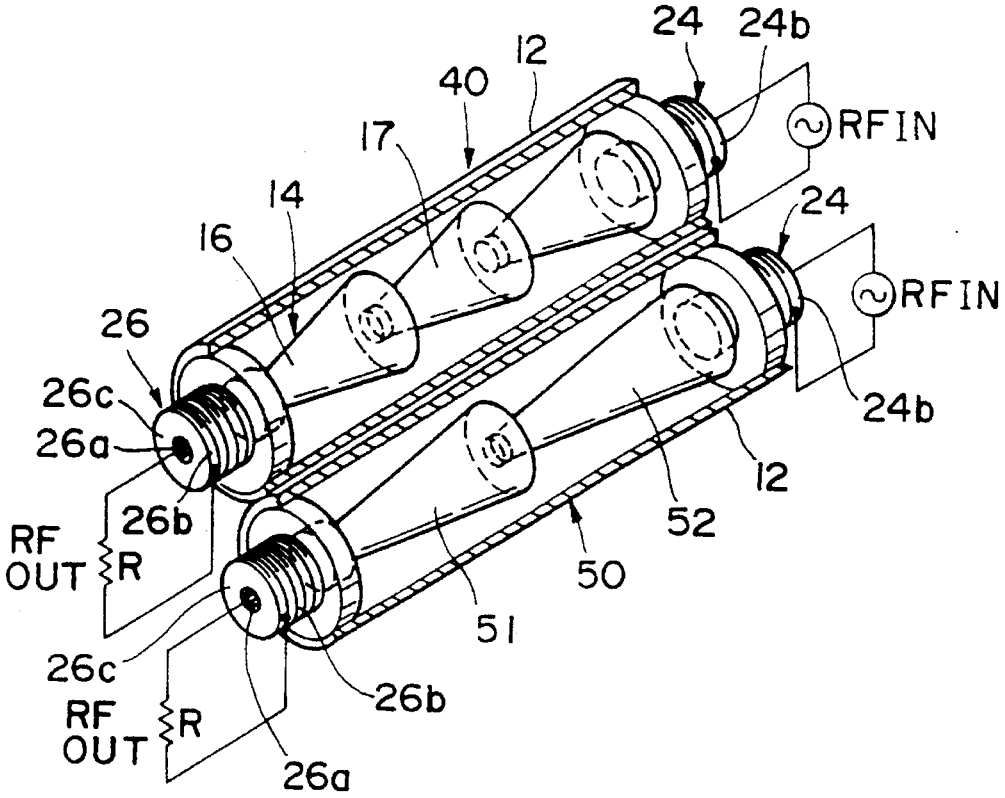
FIG. 8 is a perspective view, partly in cross section, of a high-frequency signal transmission system according to a third embodiment of the present invention.

According to a third embodiment shown in FIG. 8, two high-frequency signal transmission systems 40, 50 with different frequency bands are connected parallel to each other.

As shown in FIG. 8, the high-frequency signal transmission system 40 is identical in structure to the high-frequency signal transmission system shown in FIGS. 2 and 3. The high-frequency signal transmission system 50 has two cascaded inner conductors 51, 52 each having a total length (λ/2) greater than the total length of one of the inner conductors 16–18 of the high-frequency signal transmission system 40, the inner conductors 51, 52 corresponding to a frequency lower than that of the high-frequency signal transmission system 40. The other structural details of the high-frequency signal transmission system 50 are the same as the high-frequency signal transmission system 40.

The arrangement shown in FIG. 8 operates as follows.

High-frequency signals RFIN in different frequency ranges are supplied to the respective N-type coaxial connectors 24 of the high-frequency signal transmission systems 40, 50. The high-frequency signal transmission systems 40, 50 have different frequency bands for efficiently transmitting the supplied high-frequency signals RFIN in respective frequency bands. The operating characteristics of the high-frequency signal transmission systems 40, 50 are the same as those of the high-frequency signal transmission system shown in FIGS. 2 and 3.

The principles of the second embodiment are applicable to the arrangement according to the third embodiment. Specifically, the outer conductor 12 of each of the high-frequency signal transmission systems 40, 50 may have a pair of longitudinal slits spaced 180° from each other, and an antenna element may be connected to the central conductor 26*a* of each of the N-type coaxial connectors 26. The arrangement according to the third embodiment as modified in this manner can thus be used as an RF traveling-wave antenna. In such a modification, the high-frequency signal transmission systems 40, 50 can efficiently transmit supplied high-frequency signals in their different frequency bands.

Figure 9:
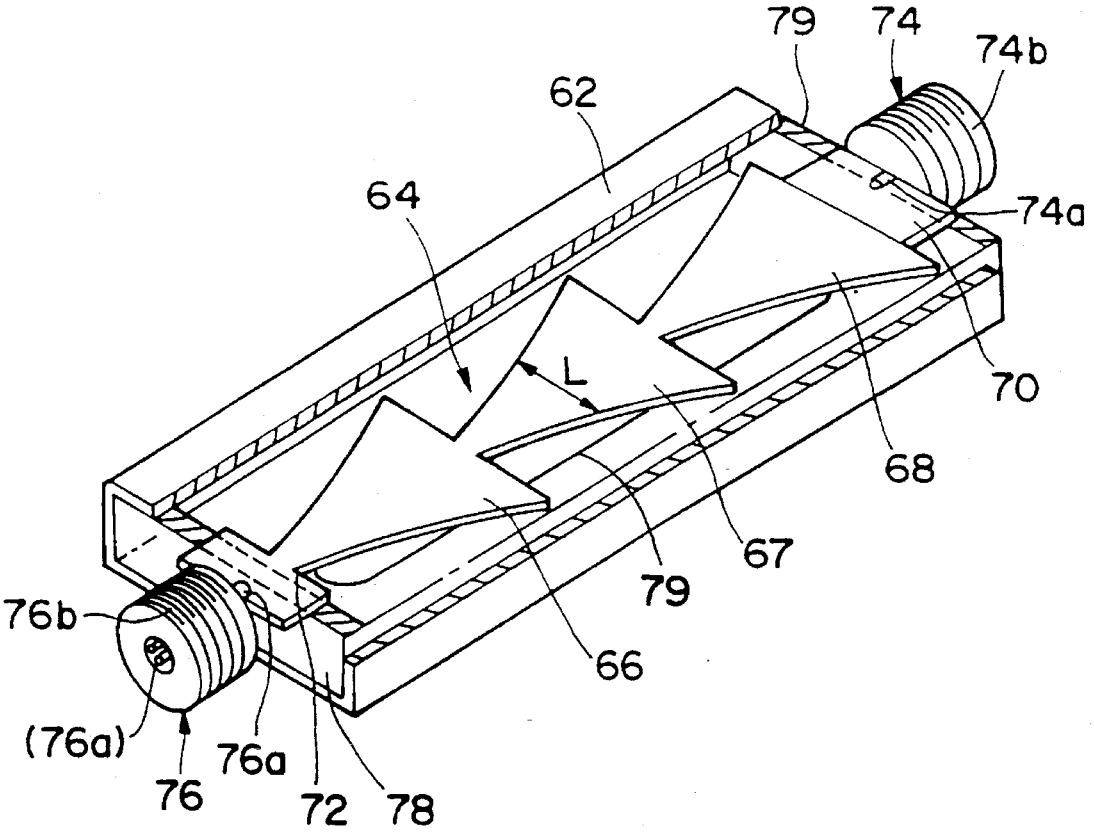
FIG. 9 is a perspective view, partly in cross section, of a high-frequency signal transmission system according to a fourth embodiment of the present invention.

FIG. 9 illustrates a high-frequency signal transmission system according to a fourth embodiment of the present invention. According to the fourth embodiment, planar inner conductors serving as exponential lines are covered with a rectangular tubular outer conductor.

Figure 9A:
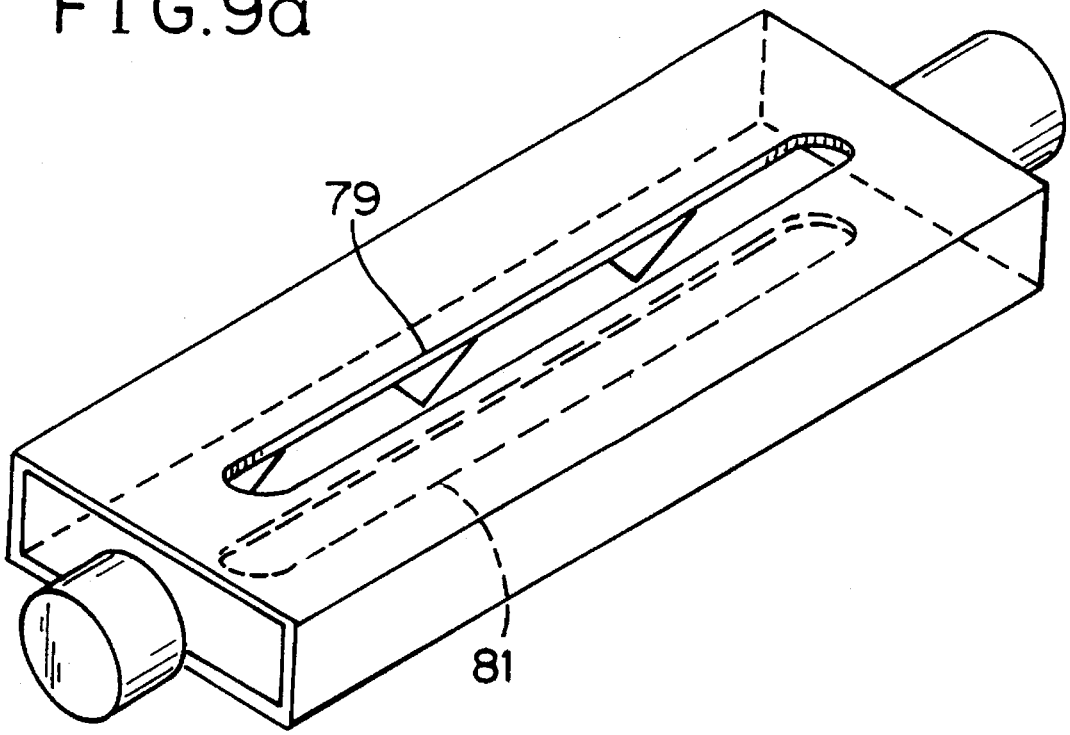
FIG. 9A is a view of the underside of the embodiment of FIG. 9 showing the longitudinal slit therein.

As shown in FIG. 9, the high-frequency signal transmission system comprises a rectangular tubular outer conductor 62, a plurality of cascaded planar inner conductors 66, 67, 68 disposed in a space 64 within the outer conductor 62 and each serving as an exponential line with opposite two sides having a unitary exponential gradient, each of the planar inner conductors 66, 67, 68 having a total length of λ/2, an impedance-matching member 70 connected to a maximum-width portion of the inner conductor 68, and an impedance-matching member 72 connected to a minimum-width portion of the inner conductor 66. Longitudinal slits 79, 81 (see FIG. 9A) are formed in outer conductor 62, which functions in a manner analogous to that of slits 31 and 32 in outer conductor 12 shown in the embodiment of FIG. 6. N-type coaxial connectors 74, 76 are connected respectively to the opposite ends of the outer conductor 62.

The inner conductors 66, 67, 68 comprise strip conductors each providing a characteristic impedance at its central region and having a unitary exponential gradient, as shaped on the basis of the parallel-ground-plate triplet stripline impedance designing theory.

A metal member 78 is fitted to close one open end of the outer conductor 62, and the N-type coaxial connector 76 has a central conductor (central contact) 76*a* inserted in a through hole (not shown) defined in the metal member 78. The central conductor 76*a* has a distal end press-fitted in or soldered to the impedance-matching member 72. The N-type coaxial connector 76 has an outer conductor 76*b* press-fitted or threaded in the metal member 78. Similarly, a metal member 79 is fitted to close the other open end of the outer conductor 62, and the N-type coaxial connector 74 has a central conductor (central contact) 74*a* inserted in a through hole (not shown) defined in the metal member 79. The central conductor 74*a* has a distal end press-fitted in or soldered to the impedance-matching member 70. The N-type coaxial connector 74 has an outer conductor 74*b* press-fitted or threaded in the metal member 79.

The impedance-matching members 70, 72 have identical dimensions, i.e., widths, to each other, which are also the same as the width L of the longitudinal intermediate exact half point portion of each of the inner conductors 66–68. The impedance-matching members 70, 72 and the inner conductors 66–68 may be pressed from a metal sheet into an integral unitary structure.

Operation of the high-frequency signal transmission system according to the fourth embodiment will be described below.

The high-frequency signal transmission system can provide a predetermined impedance of 50Ω, for example, by adjusting the thickness of the impedance-matching members 70, 72 and the inner conductors 66–68 and the distance from then to the inner surface of the outer conductor 62. Each of the planar inner conductors 66–68 serves as an exponential line, which has dimensions identical to and operates in the same manner as the inner conductors according to the first embodiment. Such an exponential line is described in "MICROWAVE TRANSMISSION CIRCUITS" published by McGraw-Hill Company, Inc. in 1948.

The principles of the second embodiment are also applicable to the arrangement according to the fourth embodiment. Specifically, the outer conductor 62 shown in FIG. 9 may have a pair of longitudinal slits spaced 180° from each other, and an antenna element may be connected to the central conductor 76*a* of the N-type coaxial connector 76. The arrangement according to the fourth embodiment as modified in this manner can thus be used as an RF traveling-wave antenna.

Two of the high-frequency signal transmission system shown in FIG. 8 which are arranged to have different frequency bands may be connected parallel to each other for efficiently transmitting high-frequency signals in the different frequency bands.

As described above, the high-frequency signal transmission system according to each of the embodiments of the present invention has a reciprocity conjugate unreflective unitary bias aperture with a cavity defined between inner conductors and an outer conductor, which constitute unitary natural base exponential lines having opposite ends sealed against leakage of high-frequency signals. Thus, a reciprocity conjugate zero-dB coupling is achieved between cascaded RF transmission lines to allow a wide unlimited transmission frequency range and avoid any phase delay between input and output high-frequency signals. The high-frequency signal transmission system includes wide-range exponential lines that are consistent with the theoretical principles and can transmit high-frequency signals highly efficiently without distortion.

Although certain preferred embodiments of the present invention has been shown and described in detail, it should be understood that various changes and modifications may be made therein without departing from the scope of the appended claims.

What is claimed is:

1. A high-frequency signal transmission system comprising:

at least one conical inner conductor, having a unitary exponential gradient and having a normalized characteristic impedance at the center represented by two cascaded circuit of a conjugate-matched uniform-impedance line;

a pair of circular lines having identical dimensions and connected respectively to opposite ends of said conical inner conductor for providing a predetermined characteristic impedance; and a cylindrical outer conductor covering said conical inner conductor and said circular lines with a cavity defined between said conical inner conductor and said cylindrical outer conductor;

further comprising a Vπ bias resistor connected between an end of one of said circular lines which is connected to one of the opposite ends thereof and said cylindrical outer conductor and a feeder connected between the other end of said conical inner conductor and said cylindrical outer conductor said cylindrical outer conductor having a longitudinal slit defined therein where by the high-frequency signal transmission system can operate an RF traveling-wave antenna.

2. A high-frequency signal transmission system according to claim 1, further comprising a lead connected to one of the opposite ends of said conical inner conductors, a Vπ bias resistor connected between an end of one of said circular lines which is connected to said one of the opposite ends thereof and said cylindrical outer conductor, and a feeder connects between the other end of said conical inner conductor and said cylindrical outer conductor, said cylindrical outer conductor having a longitudinal slit defined therein, whereby the high-frequency signal transmission system can operate as an RF traveling-wave antenna.

3. A high-frequency signal transmission system comprising:

at least one planar inner conductor, having opposite sides each having a unitary exponential gradient, and having a normalized characteristic impedance at the center represented by two cascaded circuit of a conjugate-matched uniform-impedance line;

a pair of impedance-matching lines having identical dimensions and connected respectively to opposite ends of said planar inner conductor for providing a predetermined characteristic impedance; and a rectangular tubular outer conductor covering said planar inner conductor and said impedance-matching lines with a cavity defined between said planar inner conductor and said rectangular tubular outer conductor;

further comprising a feeder connected between an end of one of the impedance-matching lines and said rectangular tubular outer conductor, said rectangular tubular outer conductor having a longitudinal slit defined therein, whereby the high-frequency signal transmission system can operate as an RF traveling-wave antenna.

4. A high-frequency signal transmission system according to claim 3, further comprising a lead connected to one of said impedance-matching lines, and a feeder connected between an end of the one impedance-matching line and said rectangular tubular outer conductor, said rectangular tubular outer conductor having a longitudinal slit defined therein, whereby the high-frequency signal transmission system can operate as an RF traveling-wave antenna.

5. A high-frequency signal transmission system according to claim 1, wherein said Vπ bias resistor has an impedance of 120Ω.

6. A high-frequency signal transmission system according to claim 2, wherein said Vπ bias resistor has an impedance of 120Ω.

7. A high-frequency signal transmission system according to claim 1, wherein said pair circular lines diameter are equal to the diameter of the intermediate portion of said conical inner conductor.

8. A high-frequency signal transmission system according to claim 2, wherein said pair circular lines diameter are equal to the diameter of the intermediate portion of said conical inner conductor.

9. A high-frequency signal transmission system according to claim 3, wherein said pair impedance-matching lines width are equal to the diameter of the intermediate portion of said planar inner conductor.

10. A high-frequency signal transmission system according to claim 4, wherein said pair impedance-matching lines width are equal to the diameter of the intermediate portion of said planar inner conductor.

* * * * *